US005769132A

United States Patent [19]

Tholander et al.

[11] Patent Number: 5,769,132

[45] Date of Patent: Jun. 23, 1998

[54] PROJECTILE OR GRIPPER SHUTTLE LOOM WITH ANTI-BALLOONING CONE FOR WEFT FEEDER

[75] Inventors: Lars Helge Gottfrid Tholander; Joachim Fritzson, both of Ulricehamn, Sweden

[73] Assignee: Iro AB, Ulricehamn, Sweden

[21] Appl. No.: 615,304

[22] PCT Filed: Sep. 13, 1994

[86] PCT No.: PCT/EP94/03059

§ 371 Date: May 13, 1996

§ 102(e) Date: May 13, 1996

[87] PCT Pub. No.: WO95/08013

PCT Pub. Date: Mar. 23, 1995

[30] Foreign Application Priority Data

Sep. 15, 1993 [SE] Sweden ..... 9303084
Oct. 4, 1993 [SE] Sweden ..... 9303266

[51] Int. Cl.[6] ..... D03D 47/34; B65H 51/22

[52] U.S. Cl. ..... 139/450; 57/58.83; 57/354; 242/47.01; 242/128; 242/157 R; 139/452

[58] Field of Search ..... 57/58.83, 354; 139/452, 450; 242/47.01, 157 R, 128

[56] References Cited

U.S. PATENT DOCUMENTS 3,411,548 11/1968 Pfarrwaller .
3,761,031 9/1973 Pfarrwaller ..... 242/47.01
3,848,820 11/1974 Stutz et al. ..... 242/18 R
3,958,404 5/1976 Kanai .
3,971,522 7/1976 Pfarrwaller ..... 242/47.01
4,367,773 1/1983 Newcomb ..... 139/452

FOREIGN PATENT DOCUMENTS 2 205 556 8/1973 Germany ..... 57/354
22 25 918 10/1973 Germany .
20 28 543 5/1975 Germany .
26 23 916 12/1977 Germany .
2 163 782 3/1986 United Kingdom .

*Primary Examiner*—Andy Falik
*Attorney, Agent, or Firm*—Flynn, Thiel, Boutel & Tanis, P.C.

[57] ABSTRACT

A projectile or gripper shuttle loom includes a weft-yarn delivery device with an overend-unwinding delivery unit that has a stationary, brakeless drum, a withdrawal eye arranged coaxially downstream of the drum and a yarn brake controlled in accordance with the loom cycle. The thread path is enclosed by at least one hollow body extending from the circumferential face of the drum to the withdrawal eye at least in one axially limited segment. The hollow body has on its inner side coaxial to the drum axis a plurality of ballooning, disturbing and braking elements which protrude inwards without touching the drum while forming projections and deposit surfaces for the weft yarn.

19 Claims, 5 Drawing Sheets

PROJECTILE OR GRIPPER SHUTTLE LOOM WITH ANTI-BALLOONING CONE FOR WEFT FEEDER

FIELD OF THE INVENTION

The present invention relates to a projectile or gripper shuttle loom having a weft-thread delivery unit which includes a stationary drum, a withdrawal eye and a yarn brake, and to a delivery unit having a storage drum from which weft yarn can be withdrawn through a yarn eye.

BACKGROUND OF THE RELATED ART

In a projectile loom known from U.S. Pat. No. 3,411,548 (FIGS. 1 to 5), the weft yarn is drawn from the drum below a cylindrical annular body, which encloses the face end of the drum, into the withdrawal eye which has arranged downstream thereof a controlled yarn brake. It is true that the annular body limits the size of the yarn balloon that forms during withdrawal, but only within a narrow axial range. A strong yarn balloon which performs braking, thereby increasing the tension level in the yarn in an inexpedient manner, is respectively formed in front and behind the annular body. Furthermore, when the yarn brake is being closed, the kinetic energy of the yarn balloon is released, whereby yarn is subsequently pulled from the windings on the drum until one or several loops of loose yarn are formed, resulting in disturbances during the next feeding operation, above all when these get caught on the annular body or on the withdrawal eye.

In a projectile loom known from DE-B-20 28 543, an internally smooth withdrawal cone is pulled on a delivery unit over a conical front nose of the drum with an intermediate spacing to limit ballooning. The withdrawal cone can be axially adjusted. The effect of the internally smooth withdrawal cone is not sufficient at the high yarn speeds in modern looms of this type. However, there might be formed a spatially limited balloon which in the cone stores a great length of yarn that relaxes upon braking, leading to the formation of loops and tangles.

Therefore, according to the above-mentioned U.S. Pat. No. 3,411,548 (FIGS. 8 to 13), it was already suggested about 30 years ago that an additional brake should be arranged on the drum, for instance a brush-type ring or a felt ring which touches the drum and fixes the yarn by clamping. This is supposed to counteract any subsequent pulling of yarn from the windings on the drum when kinetic energy is released in the yarn balloon after braking of the yarn by the controlled yarn clamp. However, such an additional brake on the drum has the serious disadvantage of a braking action which progressively increases considerably in response to the yarn speed and which inadmissibly increases the tension level in the yarn. That is why U.S. Pat. No. 3,411,548 provides for an axial temporary adjustment of the additional brake to reduce the influence thereof temporarily. Such a motional control is extremely troublesome and sluggish from a technical point of view because of the great masses to be moved.

Modern projectile looms operate at very high yarn speeds, e.g. up to 1500 m/min. Without an additional brake on the drum of the delivery unit, loops leading to frequent disturbances will be formed upon braking of the yarn by the controlled yarn clamp. Therefore, the provision of an additional brake on the drum, e.g. of the type shown in FIGS. 8 to 15 of U.S. Pat. No. 3,411,548, has generally been accepted in practice, the additional brake remaining, however, passive in a preselected position because an axial motional control of the additional brake can hardly be implemented technically in today's high-speed looms. The brake actively touches the drum with bristles, teeth or lamellae. The resultant yarn speed-dependent braking action, however, leads to an inacceptably high tension level in the yarn and is a cause for frequent yarn breakages and disturbances.

It is therefore the object of the present invention to provide a projectile or gripper shuttle loom as well as a delivery unit for such a loom wherein, despite high yarn speeds, the risk of operational malfunctions caused by loose yarn loops is considerably reduced.

SUMMARY OF THE INVENTION

This object is achieved by providing a hollow body over the storage drum which has inwardly protruding elements or projections for ballooning, disturbing and braking the yarn being withdrawn.

The hollow body permits the formation of only one yarn balloon or only a plurality of extremely small yarn balloons in which a relatively small amount of excess yarn length is stored. In addition, the projections permanently withdraw kinetic energy from the balloon. Surprisingly enough, the tension level in the withdrawn yarn becomes very low in modern looms of this type due to the combinatory effect, i.e., even at high yarn speeds. During or after braking of the yarn by the controlled yarn brake downstream of the delivery unit, it is of special advantage that the amount of kinetic energy contained in the small yarn balloon is so small that virtually no yarn is subsequently pulled from the windings on the drum on the one hand and the small amount of energy released by the activation of the controlled yarn brake is very rapidly and efficiently consumed by collision of the yarn with the projections on the other hand. The yarn which possibly relaxes does not form downwardly hanging loops any more, but is deposited on one of the deposit surfaces in orderly fashion, so that the next feeding operation starts without any trouble. In a surprisingly simple manner, the combination of the brake-free drum of the delivery unit with the hollow body eliminates the need for an additional brake in modern looms of this type, which additional brake is used for preventing dangerous loop formation after activation of the controlled yarn brake, whereby the drawback of a high yarn tension level for the major part of the feeding operation need not be put up with.

It is true that it is common practice in the yarn spooling technique (DE-A-26 23 916) to arrange a hollow truncated cone with internal projections on a face side for keeping the yarn balloon so small that it requires little space even at a high unwinding speed, and exhibits only a small braking action (low yarn tension). However, it is here irrelevant because of the continuous operation how the yarn behaves in case of a sudden delay or stop.

According to U.S. Pat. No. 3,958,404, it also is customary during spinning, doubling and twisting of spun yarn material by means of a high-speed spindle to make a balloon limitation ring enclose the spindle. This ring has inwardly protruding projections which are additionally inclined to avoid the locally concentrated heating of the yarn until melting by an enlarged contact surface during contact with the yarn. However, the process is performed continuously, so that it is irrelevant how the yarn material behaves when abruptly stopped.

Where the hollow body has a straight, concave or convex generatrix which may be parallel or inclined relative to a drum axis the hollow body may be a rotary body relative to the drum axis and can then be produced in a simple manner. A circumferentially uniform disturbance can be set for the yarn during ballooning. Along the generatrix of the hollow body, there are long deposit surfaces for the delayed or stopped yarn.

Where the hollow body has a polygonal inner cross-section, the hollow body is a rotationally symmetrical body relative to the drum axis. The projections and the deposit surfaces are solely produced by the cross-sectional shape of the hollow body.

In another embodiment, a star-shaped inner cross-section is expediently suited for disturbing purposes and for depositing the yarn.

In the star-shaped hollow body, the inner wall portions which define basic projections may have provided thereon further projections to produce a mixed form of projections which have been produced geometrically through the cross-section and of additional projections.

Where the hollow body extends from a side of a withdrawal eye over an edge of the drum from which the yarn is withdrawn, the yarn is disturbingly influenced during ballooning when being lifted from the circumferential face of the drum.

The drum may have an inner cross-section which is smaller than the drum circumference at least between the withdrawal edge and the withdrawal eye such that the hollow body is located in front of the withdrawal edge of the drum. Other disturbing measures are optionally taken in the area of the drum, e.g. where the hollow body surrounds the drum circumference with a radial space formed therebetween, by an annular body which may have a smooth inner surface.

The annular body can be an integral cylindrical extension of the hollow body which continues the hollow body in a constructionally simple manner.

Projections which are identical with or similar to the projections on the hollow body may also be provided on the inside of the annular body. It is also possible to select a different type, a different number or a different distribution of the projections in the annular body as compared with the hollow body.

At least one of the hollow body and the annular body can be mounted to a mounting on a delivery unit such that the hollow body and optionally the annular body are supported in a stable manner. The effect of the hollow body on the respective yarn quality and the respective operating conditions can be set through axial adjustability.

The hollow body can be formed of light metal, or plastics which are virtually suited for all possible yarn qualities. The hollow body or the hollow body with its annular body is lightweight, stable and resistant to wear.

Preferably, the drum diameter is about 100 mm, and the conical hollow body has a cone angle of about 120°, a large end diameter of about 110 mm, a small end diameter of about 41 mm and an axial height of about 30 mm. Further, the withdrawal eye is spaced from an end face of the drum by approximately 47 mm, and has an axial length of about 44 mm, an inner diameter of about 100 mm, and protrusions having a height of between 2 and 5 mm. The hollow body is adapted to the shape and size of the drum.

Where a controlled yarn brake is disposed directly next to the withdrawal eye, a short free yarn length is ensured between the withdrawal eye and the controlled yarn brake, so that the yarn cannot escape laterally. In a very expedient variant, the yarn brake is even arranged on the withdrawal eye.

The withdrawal eye can be replaced by the feeding eye of the controlled yarn brake.

The delivery unit which includes a hollow body coaxial to the drum permits a trouble-free supply of the weft yarn at high yarn speeds to the projectile or gripper shuttle loom, resulting in a low yarn tension level over the major part of the feeding operation because of the small balloon, while no dangerous excess length of the yarn is formed during or after braking of the yarn by the controlled yarn brake, and dangerous loops are suppressed. An additional passive brake on the drum of the delivery device, as has so far been necessary, can be dispensed with.

The delivery unit according to claim 17 is compact and operationally reliable.

BRIEF DESCRIPTION OF THE DRAWINGS

Embodiments of the invention will be explained with reference to the drawing, in which.

DETAILED DESCRIPTION

Figure 1:
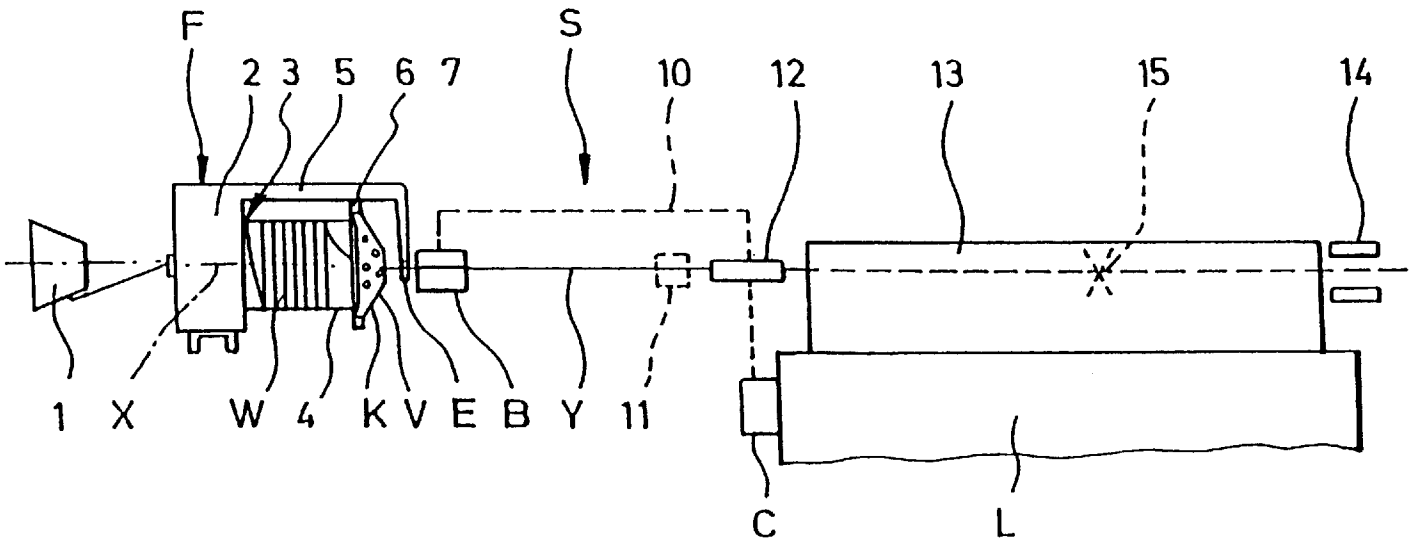
FIG. 1 is a diagrammatic side view of a projectile or gripper shuttle loom.

A weft-yarn delivery device S is mounted on a projectile or gripper shuttle loom L in FIG. 1. Although a plurality of delivery devices S are most of the time provided for alternate operation, a single delivery device is illustrated. The delivery device S includes a delivery unit F for a weft yarn Y and is equipped with a hollow body K comprising projections V on the inside and with a withdrawal eye E. A yarn brake B which is either retained as such or fixedly mounted on delivery unit F is provided downstream of withdrawal eye E.

The weft yarn Y is introduced from a supply coil 1 into a housing 2 approximately coaxially with an axis X. A rotationally drivable winding unit 3 forms windings W on a drum 4 with an approximately cylindrical circumferential or enveloping surface. On an extension arm 5, the hollow body K is fixed in a mounting 6, preferably in an axially adjustable manner, at the free face end of drum 4. The withdrawal eye E is secured to the extension arm 5 by means of a holder 7. The controlled yarn brake B is positioned at a short distance behind the withdrawal eye E or directly follows said withdrawal eye E which can then form the feeding eye of the yarn brake at the same time. The yarn brake B is, e.g., controlled via a control line 10 by a control device C in response to the weaving cycle of loom L, so that the weft yarn Y is braked at the end of a feeding operation (in the case of a projectile loom) when the projectile 12 is stopped in a catching device 14. In a gripper shuttle loom L, a braking operation is performed at the feed end and additionally in a transition phase in which a supplying gripper 12 hands over the weft yarn to a receiving gripper in a transition portion 15 (shown in broken line) in shed 13. A transfer device 11 hands over the weft yarn Y to the gripper or projectile 12. For the major part of the feeding operation the controlled yarn brake B is opened.

Figure 2B:
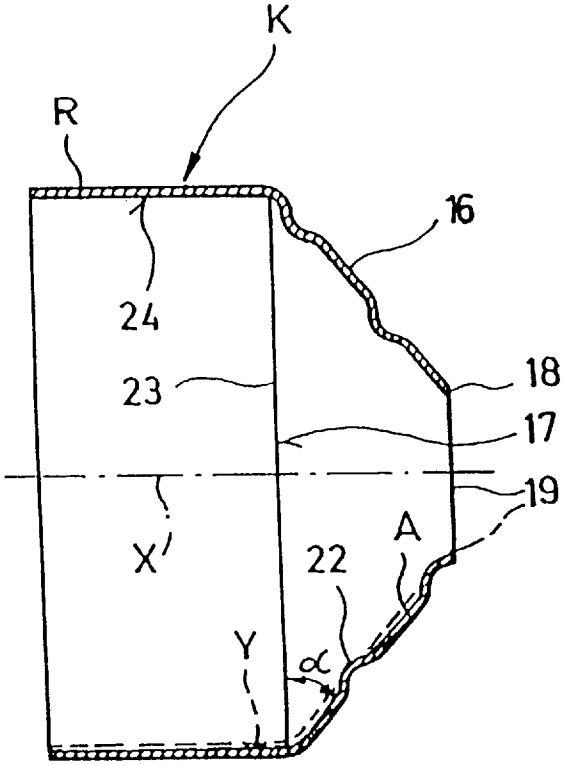
FIG. 2B shows a cross-sectional side view of the hollow body.
Figure 2A:
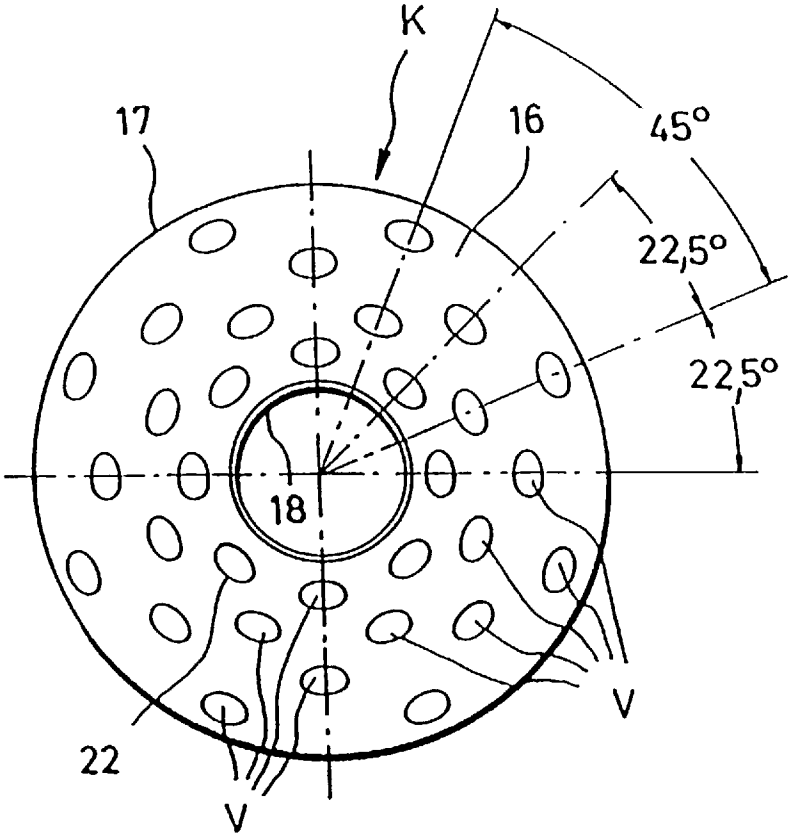
FIG. 2A shows a front elevational view of a hollow body of FIG. 1.

The hollow body K as illustrated in FIGS. 1, 2A and 2B has the shape of a frustoconical cover with a thin wall 16, a large-diameter end 17 and a small-diameter end 18 which defines a passage opening 19. The conical axis of the hollow body K corresponds to the axis X of the delivery unit F. Evenly or unevenly distributed projections V which are, for instance, shaped in the form of warts, domes, pyramids or also ribs (as outlined at 22) project inwards on the inside of the hollow body K.

The hollow body K according to FIGS. 1, 2A, 2B, 4A and 4B grips with the large-diameter end 17 over a rounded or tapered withdrawal edge 26 on the face end of drum 4. An end section of the circumferential surface of drum 4 is enclosed by a cylindrical annular body R (annular gap) which is an extension of the hollow body K in the illustrated embodiment. The inner wall 24 of the annular body R is either smooth or also provided with internally protruding projections V (FIG. 6). 23 is the transition line from the conical hollow body K to the annular body R. The annular body R is optionally retained such that it is separated and spaced apart from the hollow body K.

Figures 3, 4A, 4B:
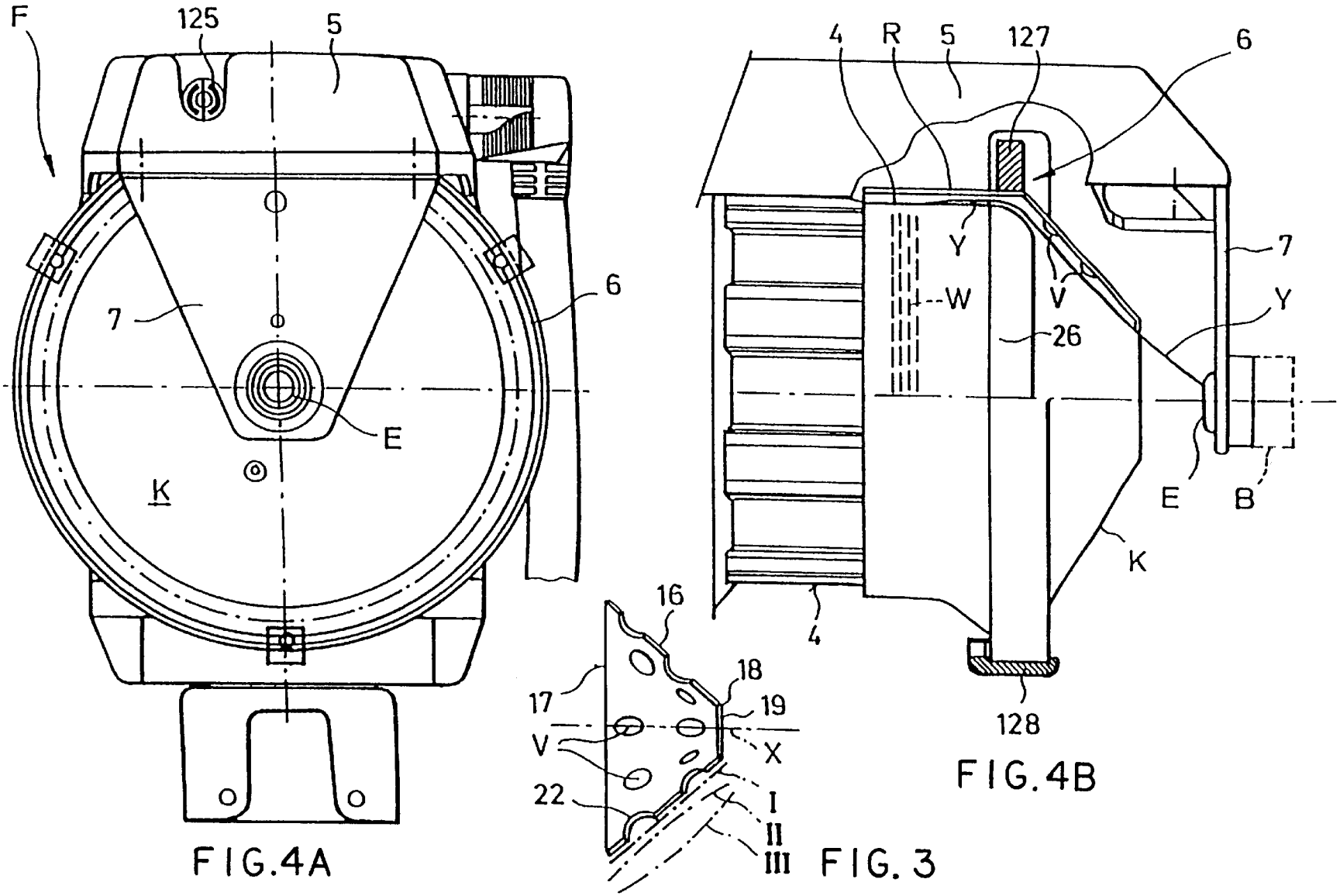
FIG. 3 shows a modified detail in a longitudinal side elevational section view.
FIG. 4A is an enlarged front elevational view of a weft-thread delivery device.
FIG. 4B is an enlarged side elevational view of the delivery device.

As becomes apparent from FIGS. 4A and 4B, hollow body K is secured with annular body R to a ring 127 which is seated with a tightening strap 128 in mounting 6 on extension arm 5. An adjusting screw 125 serves to axially adjust the hollow body K. For instance with a straight yarn path, yarn Y runs from withdrawal edge 26 to withdrawal eye E without contacting the small-diameter end of hollow body K. The controlled yarn brake B is arranged in FIGS. 4A and 4B directly behind the withdrawal eye E or on said eye. Like the annular body R, the hollow body K expediently consists of light metal. The projections V are externally impressed or indented recesses.

In the embodiment of FIGS. 4A and 4B, the annular body R extends over about 44 mm from withdrawal edge 26 rearwards, i.e. over the portion in which windings W are located on drum 4. The annular gap provided between the annular body R and the circumferential surface of drum 4 has a width of about 5 mm. The conical part of hollow body K has a cone angle of about 120°. The height of the projections V above the inner wall is between 2 and 5 mm, the diameter of the wart-shaped projections V being approximately 10 to 20 mm in the case of a cone angle of about 120°.

FIG. 3 illustrates a conical hollow body K whose shape corresponds to that of the hollow body K in FIGS. 1, 2 and 4. I illustrates a straight generatrix of the hollow body K. Alternatively, the generatrix could also be a bow line II which is convex relative to drum axis X, or a concave bow line III.

Figure 5:
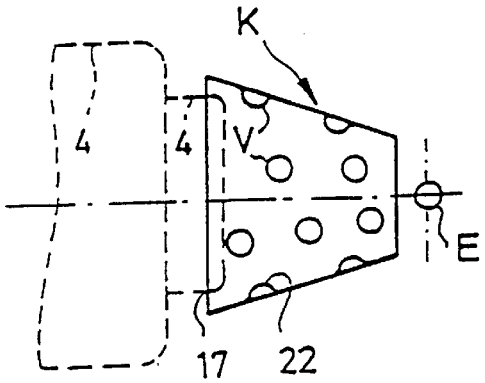
FIG. 5 is a partial side elevational view of the delivery device.
Figure 6:
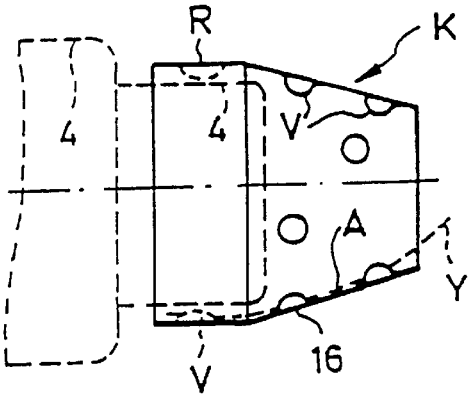
FIG. 6 is a partial side elevational view of a second embodiment of the delivery device.

As outlined in FIGS. 5 and 6, the hollow body K grips over the face end of drum 4. In such a case, the outer diameter of drum 4 is smaller than the inner diameter at the large-diameter end of hollow body K. However, it is also possible to position the hollow body K according to FIG. 5 at some distance in front of drum 4. The large-diameter end of hollow body K is then expediently approximately equal to or smaller than the drum diameter.

According to FIG. 6, the hollow body K grips with the integrated annular body R either over the face end of drum 4 (outlined in broken line), or it is arranged at some distance in front of the face end of drum 4. In the first-mentioned case, the diameter of the annular body R and of the large-diameter end of the conical part of the hollow body K is larger than the outer diameter of drum 4. In the second case, the diameter is either equal to or preferably smaller than the drum diameter. As further outlined in FIG. 6, the hollow body K forms deposit surfaces A for the weft yarn Y on which the weft yarn Y is temporarily deposited after a braking operation in such a manner that it does not hang freely downwards anywhere.

Figure 7:
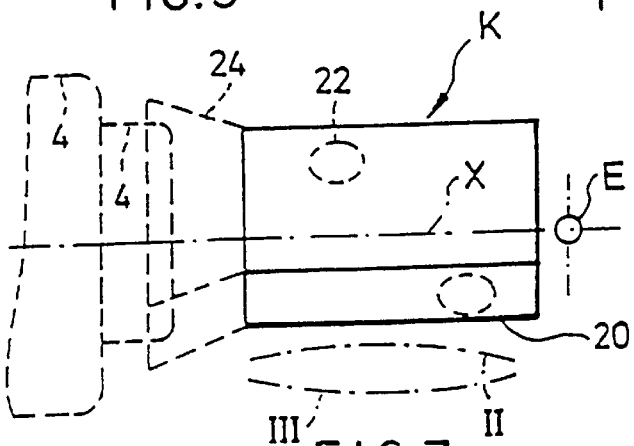
FIG. 7 is a partial side elevational view of a third embodiment of the delivery device.

FIG. 7 shows, in full lines, a modified embodiment of a hollow body K which is, for instance, a section of a profile tube 20 having a polygonal inner cross-section (there is shown a cross-section in the form of an equilateral triangle) and is positioned in front of the face end of drum 4 (outlined in broken line) with longitudinal edges parallel to drum axis X. Drum axis X expediently extends through the area center of gravity of the inner cross-section of hollow body K. Straight or optionally curved inner wall portions 23 which serve as inwardly protruding projections to influence the movement of the weft yarn in the circumferential direction about the drum axis are positioned between the corners of the inner cross-section, which are designated by 21. Additional projections 22, V are optionally provided on the inner wall portions 23 according to the projections of the conical hollow body K according to FIG. 5.

Furthermore, as shown in broken line in FIG. 7, the hollow body K has a conically enlarged extension 24 which is continued with the same inner cross-section and optionally grips over the face end of drum 4 or is opposite to said end at some distance. The inner cross-section of the hollow body K or of the conical extension 24 is expediently smaller than the cross-section of the drum enveloping surface. This is not an imperative prerequisite. The hollow body K according to FIGS. 7 and 8 could also, as shown at II and III, extend in arcuately retracted fashion or arcuately curved fashion.

Figure 8:
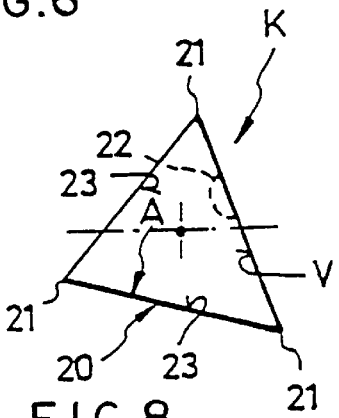
FIG. 8 is a front elevational view of the hollow body of FIG. 7.
Figure 9A:
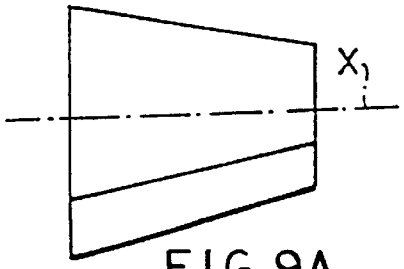
FIG. 9A is a partial side elevational view of the hollow body of a fourth embodiment of the delivery device.
Figure 9B:
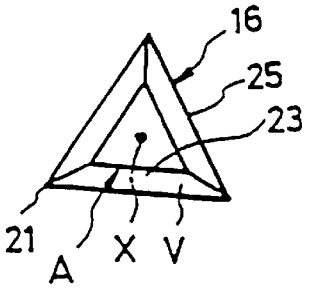
FIG. 9B is a front elevational view of the hollow body of FIG. 9A.

In FIGS. 9A and 9B, the hollow body K is similar to that of FIGS. 7 and 8, the body being conically tapered towards the withdrawal eye E. The inner wall portions 23 which connect corners 21 form the projections V in the hollow body K formed with a cover 25. Furthermore, the inner wall portions 23 define deposit surfaces A for the relaxed and braked weft yarn. Inside the conical extension of the hollow body K according to FIGS. 9A and 9B, there might also be a narrowed portion or bulging portion in the course of the longitudinal edges according to the dash-dotted lines II and III with inwardly directed inclination towards the withdrawal eye.

Figure 10A:
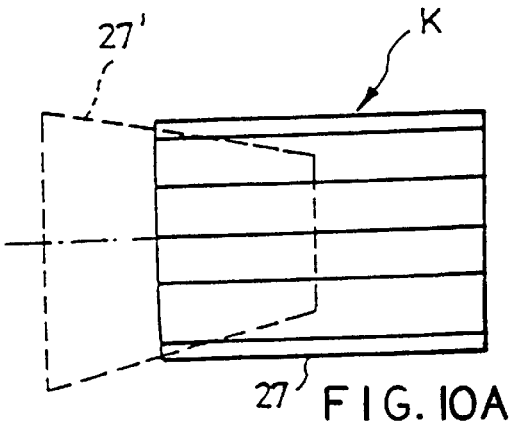
FIG. 10A is a partial side elevational view of the hollow body of a fifth embodiment of the delivery device.
Figure 10B:
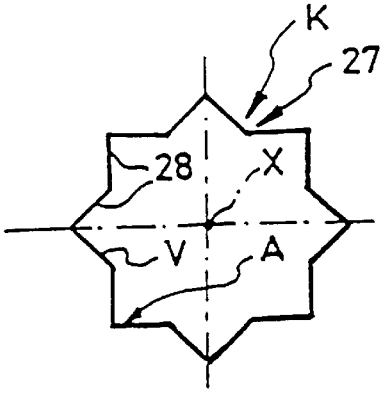
FIG. 10B is a front elevational view of the hollow body of FIG. 10A.

In FIGS. 10A and 10B, the inner cross-section of the hollow body K is star-shaped with inner wall portions 28 which are set in zigzag-shaped fashion relative to each other and which define the projections V and the deposit surfaces A. The hollow body K according to FIGS. 10A and 10B could be a tubular section 27 with constant inner cross-section, or conical, as outlined at 27'.

Figure 11A:
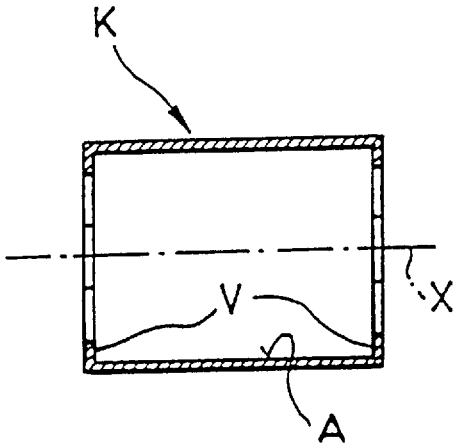
FIG. 11A is a partial side elevational view of the hollow body of a sixth embodiment of the delivery device.
Figure 11B:
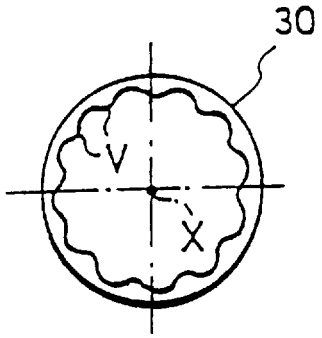
FIG. 11B is a front elevational view of the hollow body of FIG. 11A.

In FIGS. 11A and 11B, the hollow body K is a cylindrical tubular section 30 with axially defined inwardly protruding projections V, e.g. on the front and rear ends. The inner wall forms deposit surfaces A. The hollow body K according to FIGS. 11A and 11B could be conical or curved or narrowed.

Figure 12A:
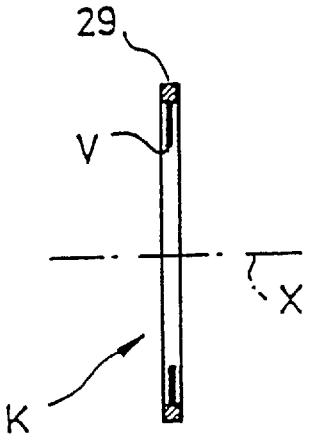
FIG. 12A is a partial side elevational view of the hollow body of a seventh embodiment of the delivery device.
Figure 12B:
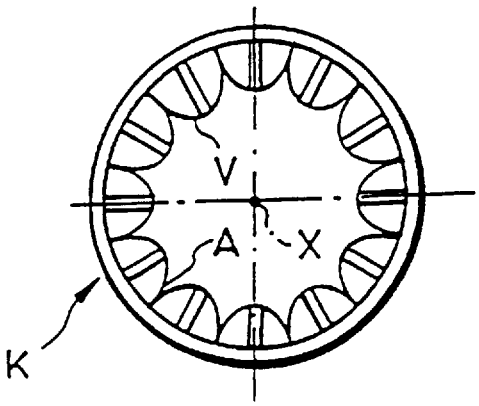
FIG. 12B is a front elevational view of the hollow body of FIG. 12A.

FIGS. 12A and 12B show an annular hollow body K which has a basic body 29 with inwardly protruding projections V between which deposit surfaces A are disposed. The hollow body K according to FIG. 12 is coaxial to the drum axis. The projections V could also be rounded or formed differently. Furthermore, they could be bent outwards from the plane of basic body 29 either towards the drum or to the withdrawal eye or alternately. A plurality of such hollow bodies might also be arranged subsequently.

The withdrawal eye E could be supported in the end of hollow body E, or the end of hollow body A might be formed as a withdrawal eye. The controlled yarn brake B could then be mounted on the hollow body K directly. A yarn brake B which clamps the yarn is used as a controlled yarn brake B, as is common in projectile looms.

We claim:

1. A projectile or gripper shuttle loom comprising a weft-thread delivery unit having a stationary drum for withdrawal of a weft yarn stored in windings on said drum over an end thereof, a withdrawal eye arranged in a yarn path through which said yarn is withdrawn downstream of said drum, and a yarn brake which is provided downstream of said withdrawal eye for braking said yarn being withdrawn, said yarn path being enclosed by at least one hollow body which extends from a circumferential surface of said drum toward said withdrawal eye at least in an axially limited segment, said circumferential surface extending in approximately parallel fashion up to a withdrawal edge of said drum, a cylindrical annular body surrounding said circumferential surface near said withdrawal edge at a radial distance therefrom, at least one of said hollow body and said annular body being fixed on a mounting on an extension arm of said delivery unit in an axially adjustable manner, said at least one hollow body being disposed coaxial to a drum axis of said drum and having on an inner side thereof a plurality of inwardly protruding balloon disturbing and braking elements which end at a distance from said drum, said elements forming circumferentially acting projections and deposit surfaces for said weft yarn, said elements contacting said yarn when said yarn is braked for limiting ballooning of said yarn.

2. A loom according to claim 1, wherein said withdrawal eye and said drum are disposed in coaxial relation.

3. A loom according to claim 1, which includes control means for controlling said yarn brake in response to a loom cycle.

4. A loom according to claim 1, wherein the inner side of said hollow body has a generatrix which is either straight or is concave or convex relative to said drum axis and which is either in parallel with said drum axis to define a substantially cylindrical shape or is inwardly obliquely inclined towards said withdrawal eye to define a substantially conical shape.

5. A loom according to claim 1, wherein said hollow body is a section of a profile tube having a polygonal inner cross-section, said hollow body having inner wall portions which extend between corners of said cross-section so as to form said balloon, disturbing and braking elements and said deposit surfaces.

6. A loom according to claim 5, wherein further projections protrude inwardly from said inner wall portions.

7. A loom according to claim 5, wherein said polygonal inner cross-section has a triangular shape.

8. A loom according to claim 1, wherein, when viewed in cross-section, said hollow body has a star-shaped inner side with inner wall portions abutting on one another in zigzag-shaped fashion so as to form said balloon, disturbing and braking elements and said deposit surfaces.

9. A loom according to claim 1, wherein said hollow body is arranged between a withdrawal edge of said drum and said withdrawal eye, and an inner cross-section of said hollow body is smaller than a cross-section of the circumferential surface of said drum at least at a point between said withdrawal edge and said withdrawal eye.

10. A loom according to claim 1, wherein said annular body is an integral cylindrical extension of said hollow body comprising projections and deposit surfaces on an inside thereof.

11. A loom according to claim 1, wherein the inside of said annular body has provided thereon inwardly protruding projections which have inner end portions that are spaced apart from said drum.

12. A loom according to claim 1, wherein said hollow body is a shaped part formed of light metal, metal or plastics.

13. A loom according to claim 1, wherein said drum has a drum diameter of about 100 mm, and said conical hollow body which has a cone angle of about 120°includes a large end diameter of about 110 mm, a small end diameter of about 41 mm and an axial height of about 30 mm, said withdrawal eye being spaced apart from the face end of said drum approximately 47 mm, and the annular body having an axial length of approximately 44 mm at an inner diameter of about 100 mm, said protrusions being formed as domes or pyramid-shaped members having a height of between 2 and 5 mm.

14. A loom according to claim 1, wherein said yarn brake is provided directly next to said withdrawal eye.

15. A loom according to claim 1, wherein said weft-thread delivery unit is free of a yarn brake upstream of said hollow body.

16. A projectile or gripper shuttle loom comprising a weft-thread delivery unit having a stationary drum for withdrawal of a weft yarn stored in windings on said drum over an end thereof, a withdrawal eye arranged in a yarn path through which said yarn is withdrawn downstream of said drum, said withdrawal eye and said drum being in coaxial relation, and a yarn brake which is provided downstream of said withdrawal eye for braking said yarn being withdrawn, control means being provided for controlling said yarn brake in response to a loom cycle, said yarn path being enclosed by at least one hollow body which extends from a circumferential surface of said drum toward said withdrawal eye at least in an axially limited segment, said circumferential surface extending in approximately parallel fashion up to a withdrawal edge thereof, a cylindrical annular body surrounding said circumferential surface near said withdrawal edge at a radial distance therefrom, at least one of said hollow body and said annular body being fixed on a mounting on an extension arm of said delivery unit in an axially adjustable manner, said at least one hollow body being disposed coaxial to a drum axis of said drum and having on an inner side thereof a plurality of inwardly protruding balloon disturbing and braking elements which end at a distance from said drum, said elements forming circumferentially acting projections and deposit surfaces for said weft yarn, said elements contacting said yarn when said yarn is braked for limiting ballooning of said yarn.

17. A loom according to claim 16, wherein said yarn is disposed in a spaced relation from said inner side during withdrawal of said yarn from said drum.

18. A loom according to claim 16, wherein said weft-thread delivery unit is free of a yarn brake upstream of said hollow body.

19. A loom according to claim 16, wherein said annular body includes a plurality of said elements protruding inwardly therefrom.

* * * * *